US009504870B2

(12) United States Patent
Strong Crawley et al.

(10) Patent No.: US 9,504,870 B2
(45) **Date of Patent: *Nov. 29, 2016**

(54) STABILITY EXERCISE MACHINE

(71) Applicants: Amy Caroline Strong Crawley, Draper, UT (US); William Joseph Crawley, Draper, UT (US)

(72) Inventors: Amy Caroline Strong Crawley, Draper, UT (US); William Joseph Crawley, Draper, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/161,845

(22) Filed: May 23, 2016

(65) Prior Publication Data

US 2016/0263422 A1 Sep. 15, 2016

Related U.S. Application Data

(62) Division of application No. 14/523,794, filed on Oct. 24, 2014, now Pat. No. 9,345,924, which is a division of application No. 13/045,496, filed on Mar. 10, 2011, now abandoned.

(60) Provisional application No. 61/312,610, filed on Mar. 10, 2010.

(51) Int. Cl.

| | |
|---|---|
| ***A63B 26/00*** | (2006.01) |
| ***A63B 23/02*** | (2006.01) |
| ***A63B 22/16*** | (2006.01) |
| ***A63B 21/078*** | (2006.01) |
| ***A63B 21/00*** | (2006.01) |

(52) U.S. Cl.
CPC ..... *A63B 21/078* (2013.01); *A63B 21/00069* (2013.01); *A63B 21/15* (2013.01); *A63B 21/4029* (2015.10); *A63B 22/16* (2013.01); *A63B 23/02* (2013.01); *A63B 26/003* (2013.01); *A63B 2225/62* (2013.01)

(58) Field of Classification Search
CPC ..... A63B 21/00047; A63B 21/078; A63B 21/4029–21/4031; A63B 22/16; A63B 26/003; A63B 2225/62
See application file for complete search history.

(56) References Cited

U.S. PATENT DOCUMENTS

| | | | | |
|---|---|---|---|---|
| 9,345,924 | B2 * | 5/2016 | Strong Crawley | A63B 21/078 |
| 2005/0020418 | A1 * | 1/2005 | Lin | A63B 21/0552 482/142 |
| 2010/0004099 | A1 * | 1/2010 | Fey | A63B 21/00181 482/94 |

* cited by examiner

*Primary Examiner* — Loan H Thanh
*Assistant Examiner* — Jennifer M Deichl

(57) ABSTRACT

A exercise machine with an air filled bladder or other resilient member which provides a support surface for a user exercising thereon. The exercise machine providing many of the benefits of a traditional weight bench, while also providing the potential upside of incorporating an instability thereby engaging the user's core during exercise. A resilient member can be shaped according to the needs of the exercise to be performed. The resilient nature of the cushion limits bottoming out providing a true cushion support rather than a hard surface.

20 Claims, 16 Drawing Sheets

STABILITY EXERCISE MACHINE

CROSS-REFERENCE TO RELATED APPLICATIONS

This application is a division of U.S. patent application Ser. No. 14/523,794 filed Oct. 24, 2014, which is a division of U.S. patent application Ser. No. 13/045,496, filed Mar. 10, 2011, which claims priority to, and the benefit of, U.S. Provisional Application No. 61/312,610, filed Mar. 10, 2010, all of which are incorporated herein by reference in their entireties.

BACKGROUND

1. The Field of the Invention

The present invention relates to exercise machines and exercise benches with seats, platforms and/or other cushions which are filled with air, or otherwise are provided with a desired degree of instability to engage the user's core muscles to maintain balance when exercising.

2. The Relevant Technology

Advances Traditional weight benches, while having a variety of configurations, are typically designed to provide a support surface allowing a user to perform repetitive exercise movements in a safe and effective manner. The bulk of weight benches and exercise machines typically rely on foam rubber or other foam like cushioning material covered in vinyl or other suitable fabric. The underlying foam is configured to add comfort and support to the user while the use sits or lays on the bench during a workout.

Traditional benches which utilize or rely on foam or other similar material in the production of these platforms have several drawbacks. For example, a solid, cushioned platform may provide sufficient support to allow for repetitive motions of exercise, but still fail to provide sufficient instability to truly engage the user's core muscles. Typically such platforms, are more utilitarian in nature thus lacking the ergonomics to conform a user's unique body shape. Additionally, the solid or semi solid materials such as foam, gel, foam rubber and their support surfaces cannot be adjusted to meet the needs of individual users. For example, areas of stiffness, softness and other which relate to the user's comfort are often lacking in any meaningful degree. Such foam, gel or rubber surfaces also tend to bottom out resulting in the user laying directly on a hard underlying substrate surface. Materials may degrade and flatten our over time, thus reducing their effectiveness, safety and comfort. As a result, shortcomings in the material properties of the bench's cushion may reduce the overall performance of the exercise bench. For example, by providing simple foam cushions which tend to compress to the point where the user is resting on the equivalent of a hard surface results in pressure on bone and joint which can result in the potential for multiple use injuries to a user.

New and expanded knowledge of the importance of strengthening the body's core muscle groups have led to exploration of new exercise methods. For example, in recent years stability balls or exercise balls (commonly known as 'Swiss Balls') have become increasingly popular. However these exercise balls regardless of their size and other slight variations have many drawbacks and can actually be fairly dangerous. For example, some users combine the use of exercise balls with weights. However, rolling, rupturing or other unexpected occurrences can lead to potential harm to the user.

Support stands which have been developed for some exercise balls can provide an increased level of support for the ball, but still suffers many deficiencies. For example, the spherical shape can be difficult to use in many exercises. A spherical shape can be very poor shape for exercise. Spherical shapes provide a fairly limited support area for the user. Additionally, providing a support surface to existing balls does little to decrease the fact that exercise balls are prone to bursting which can cause injury.

BRIEF SUMMARY OF THE INVENTION

These and other limitations are overcome by embodiments of the invention which relate to systems and methods for This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

The presently claimed invention is directed to a preacher curl exercise machine having an instability cushion according to one embodiment of the present invention. In some embodiments, the seat comprises a seat instability cushion. Further in some embodiments arm/elbow rests can comprise arm instability cushions. Various components of the machine can be adjustable to provide a desired configuration of the machine 80 and for users of different heights. The preacher curl exercise machine can include the seat instability cushion, a chest instability cushion and/or one or two elbow instability cushions. The resilient member can be filled with air, similar gasses, liquids, gels or other fillers which allow the fillable bladder to provide resiliency and support, while also allowing for a desired degree of instability. In this manner the user can utilize many of the traditional benefits of a preacher curl bench, while also providing the potential upside of engaging the user's core during exercise.

Additionally, a desired level of instability in the resilient support surface allows engaging of the user's core, without the risks of rupture of the bladder, rolling of an exercise ball, or a level of instability which could cause the user to entirely loose balance which could result in unnecessary lateral strain, dropping of a weight or pose an unnecessary risk of injury.

In addition, the preacher curl bench may have an adjustable air filled seating apparatus and can reduce skeletal pressure by using air instead of foam. The preacher bench creates core engagement by creating an unstable surface in both arm and seat rest. The preacher curl bench pressure can be adjusted to differing levels of difficulty and muscle engagement. The preacher curl bench which uses air, gel or other gases to create better ergonomics and can slow down exercise repetitions by placing the user on surfaces which are filled with air, gas or gel. The preacher curl bench can allow the use of less weight because of the use of air, gel or other gases and can allow the user to adjust comfort levels by inflating or deflating its surface. The air pressure within the preacher curl bench blatter can be controlled by the use of an air gauge and can be varied between the seat and arm rests. For example, the air pressure within the seat can be greater than the arm rests thereby increasing the ergonomics during use. Moreover, the thickness of the plastic may not be uniform across the width of the seat and/or the arm rest.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
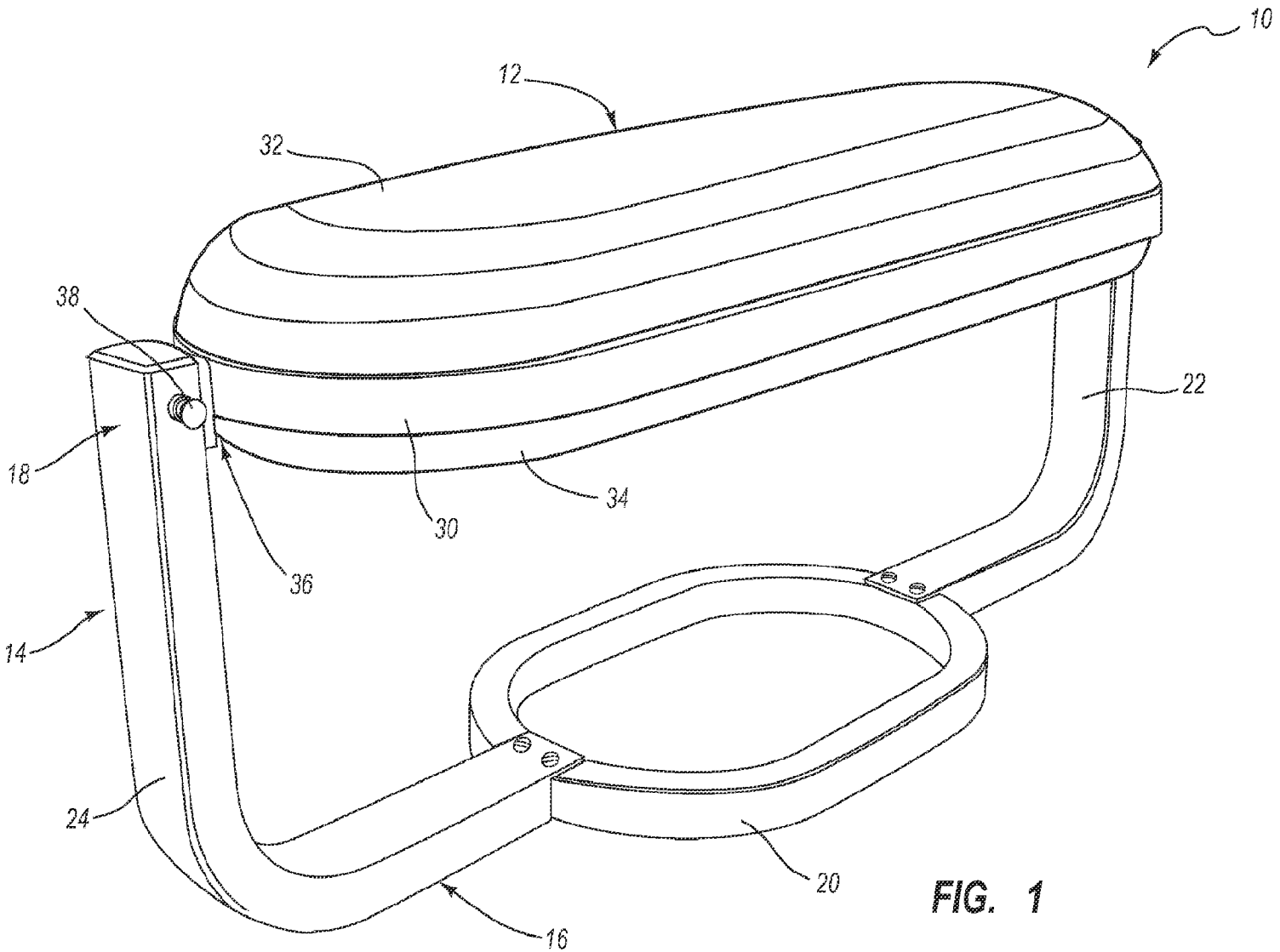
FIG. 1 is a perspective view of a stability cushion exercise machine according to one aspect of the present invention.

The present invention is related to a stability cushion exercise machine that includes a support frame for supporting a cushion component at a location off of the ground so that the user of the stability cushion exercise machine can do one or more exercises while being supported at the level above the ground. For example, a cushion component for providing a seat or a back support for a bench press can be located by the frame at least six inches off the ground or at least one foot off the ground. The frame can be similar, or the same, as a common bench, chair, preacher curl, or other typical weight lifting support frame. However, according to the teachings herein, the foam pad typically used at support points for the person exercising are replaced with one or more air-filled bladders. These air-filled bladders have many advantages over foam-filled pads as discussed herein and as will become apparent as the different embodiments are further explained.

For example, air-filled cushion components can have their support traits tailored over a length, width, or radially by changing the relative thickness of the cushion material over the length, width, or radially of the cushion. Different materials with different elasticities can be used to create composite cushions, with different support characteristics at different locations of the air-filled cushions. And, the internal pressure of the air, or other gas, can be varied to change the support characteristics of the cushion. This change in internal air pressure can be changed "on the fly", even during a workout, so as to entirely tailor the support characteristics for the particular user or exercise. For example, a user who is relatively heavy may enjoy an air pressure or cushion design that is designed for their weight and preferences as compared to a user who is relatively light.

The air-filled cushion can be entirely devoid of anything but gas. So, for example, the air-filled cushion would not have any foam within the cushion or it could have a relatively low level of foam within.

According to some embodiments disclosed herein the cushion can have a fluid or gel within the cushion. However, according to the preferred embodiments, the cushion has air within the cushion and the cushion acts as a deformable bladder conforming the user's body during an exercise. For example, the size and shape of the cushion can be tailored for the particular exercise being performed and the support point of the user where a cushion for a support point for a user's arm might be smaller than a cushion for a support point for a user's back. Moreover, the size and shape of the cushion can be tailored to the length of the user's triceps in a preacher curl embodiment whereas the size and shape of the cushion supporting the user's back in a bench press embodiment would be much longer and wider to sufficiently support the user's back.

The volume of air within the air bladder of such a cushion can vary from at least 6 cubic inches in a small cushion to at least 1 cubic foot or 2 cubic feet in a larger cushion, or more. In each embodiment, as discussed above, the gas is compressible, and therefore, creates an outward pressure on the inside surface of the bladder of the cushion. And, this outward pressure is displaced by the weight or the user or by pressure against the pressure points of the user so as to deform the cushion and create an instability for the user during the exercise so as to encourage use of core muscles and other stabilizing muscles to maintain the user's desired stability while exercising on the cushion component.

The pressure of the air, or other gas, within the cushion can be at least 5 pounds per square inch, at least 10 pounds per square inch, at least 15 pounds per square inch, at least 20 pounds per square inch, at least 25 pounds per square inch, or more. The pressure of the air can be adjustable as discussed above, or can be set at a predetermined optimum pressure. The pressure of the air can be selected based on the exercise, the size and/or shape of the user, and/or the strength of the user. So, where a particular user is stronger than another particular user and will lift more weight as a result, a different more resilient cushion can be selected or the air pressure within the cushion can be varied to compensate for the variation in user body shape, strength, and/or particular exercise chosen.

The embodiments herein need not use only air-filled cushions but can also include a combination of air-filled cushions, fluid-filled cushions, and/or foam filled cushions. Preferably, however, at least one air-filled cushion is implemented to resulting the core strengthening advantages that the inventor of this application has discovered by using the exercise machines disclosed herein.

In a bench embodiment the bench can have adjustable angles and can have a weight support structure of the frame configured to support the weights supported by a bar at an accessible level above the user prior to and after a bench press exercise.

Similarly, a preacher-curl embodiment can include a similar weight supporting structure for supporting a curl-bar or other bar holding weights prior to and after a preacher-curl exercise.

The inventors of this patent application have found an unexpected and synergistic result from the combination of elements disclosed herein, and claimed, beyond the various independent exercise components. The fitness machines disclosed herein offer a new and unexpected core strengthening result while additional beneficial muscle exercises are simultaneously conducted to the other muscles and muscle groups. And, the ergonomic effect of the body shape designed air cushion support further enhances the synergistic and unexpected results. For the fitness industry, the introduction of such synergistic designs does not require a reconfiguration, or expansion, of a current exercise facility. Rather, the designs herein can be included, or supplemented, within the current fitness center layout and facilities without undesirable extra expenditures or reconfigurations. Further features and advantages can be apparent from the disclosure hereinafter and will be apparent to one of ordinary skill after reading this disclosure.

FIG. 1 is a perspective view of a stability cushion exercise machine 10 according to one embodiment of the present invention. According to the illustrated embodiment of the present invention, the stability cushion exercise machine 10 includes a cushion 12 and a frame 14. Frame 14 is representative of a variety of support mechanisms for supporting a user during a desired exercise.

Cushion 12 is supported by the infrastructure provided by frame 14. Cushion 12 is one example of a cushion component. Cushion 12 is also one example of an air filled resilient member. In the illustrated embodiment, cushion 12 provides a support surface which minimizes bottoming out during exercise.

The size, dimension, and material properties of cushion 12 are selected to provide a desired degree of instability to a user exercising or otherwise positioned on cushion 12. Depending on the type of exercise the bench is configured to provide, cushion 12 can comprise a seat, platform and/or other surface for laying and/or sitting during exercise. Use of cushion 12 encourages and/or requires a user to use core muscles to maintain desired stability during repetitive motion exercises. Core muscles tend to be muscles which run the length of the trunk and torso and are utilized to stabilize the spine, pelvis and shoulder girdle to create a solid base of support for normal body movement. Such core muscles can include, but are not limited to the Rectus Abdominus, Erector Spinea, Multifidus, External Obliques, Internal Obliques, Transverse Abdominis, Hip Flexors, Gluteus medius, Gluteus minimus, Gluteus maximus, hamstrings, piriformis and hip abductors.

The configuration of cushion 12 allows a user to exercise more than one muscle group. While traditional exercise balls typically are focused on abdominal exercises, by incorporating air surfaces into traditional weight benches and weight machines, the user can focus on building extremity muscles while simultaneously building their core muscles. The synergies of shaping air surfaces and traditional weight benches makes such benefits possible.

As will be appreciated by those skilled in the art, the particular core muscles which are employed during a particular exercise can depend on the type and nature of stability cushion exercise machine and the type and nature of exercise performed on the machine. It should also be understood that while the stability cushion exercise machine can improve the exercise of core muscles, other muscle groups can also be targeted, or provided with enhanced workout by use of a stability cushion exercise machine.

In the illustrated embodiment, frame 14 is depicted. Frame 14 can include a variety of exercise benches and exercise machines that are similar in height, length and size as traditional benches, machines. The dimensions of frame 14 can be selected to allow a user to better place themselves in a multitude of exercise positions while laying or sitting on a surface filled with air. Frame 14 includes a base support stand 16, a rotation member 18, a base support member 20, a first upright support member 22 and a second upright support member 24. Frame 14 can also include bench support frame 30 according to one embodiment of the present invention. According to another embodiment of the present invention, bench support frame 30 comprises a portion of cushion 12.

Base support stand 16 provides infrastructure for stabilizing frame 14 relative to the floor, or other support surface, upon which stability cushion exercise machine 10 is positioned. Base support stand 16 includes a lower contact surface which directly contacts the support surface or floor. Additionally, base support stand extends laterally substantially the entire length of stability cushion exercise machine.

In the illustrated embodiment, base support stand 16 includes a base support member 20. Base support member 20 is positioned centrally with respect to the other components of frame 14. Base support member 20 has a generally elliptical shape which extends laterally from the central axis provided by the other components of base support stand 16. In this manner, base support member 20 provides lateral support to frame 14 to minimize undesired tipping or other instability to frame 14 relative to the ground.

Frame 14 includes a first upright support member 22 and a second upright support member 24. First upright support member is secured to one end of base support member 20 along the central axis of base support member 20. Second upright support member 24 is secured to base support member 20 at the other end of base support member 20 at a position along the central axis of base support member 20. First and second upright support members 22 and 24 have a first portion which is adapted to remain in contact with the floor for a predetermined distance. A second portion of upright support members 22 and 24 are adapted to extend in an upright manner so as to provide desired support for cushion 12. A third and middle portion of each of upright support members 22 and 24 are adapted to provide a curved or angled transition from the first portion to the second portions of each of first and second upright support member 22 and 24. This allows a substantially 90 degree angle to be formed between first and second portions of upright support members.

In the illustrated embodiment, the cushion assembly 12 is secured to the frame 14 at the upper ends of first upright support member 22 and second upright support member 24. In the illustrated embodiment, cushion assembly 12 comprises a bench support frame 30, an instability cushion 32 and a secondary cushion member 34. Support frame 30 comprises a component on which the other members of cushion assembly 12 are mounted. Instability cushion 32 comprises a resilient member which provides a support surface on which a user can sit/stand or otherwise utilize during exercise. In the illustrated embodiment, instability cushion 32 is formed from a resilient material having a durometer which provides a desired level of support, but also the resiliency needed to achieve a degree of instability which encourages a user to engage his/her core muscles to maintain a desired degree of stability on the instability of cushion 32. In the illustrated embodiment, the instability cushion has a desired degree of arc to provide an instability ball like feel, while also have an elongate configuration which can be useful for bench press, pectoral fly or other exercises where the user is positioned on his/her back.

In the illustrated embodiment, a pivot mechanism 36 is provided. Pivot mechanism 36 allows a user to rotate cushion assembly 12 such that secondary cushion member 34 is positioned upward. In this manner, in the event that the user desires to conduct traditional exercises using a more traditional stable support surface, the secondary cushion member 34 is provided. A rotation pin 38 is provided to selectively secure or release the pivot mechanism to allow for free and full rotation of cushion assembly 12.

According to one embodiment of the present invention, the resilient member forming cushion 12 is secured to frame 14 utilizing a support ring and a base plate. Support ring and base plate can be made utilizing a number of materials including, but not limited to steel, plastic, aluminum, carbon fiber and so forth. The membrane or bladder forming from which cushion 12 is formed has a flange which runs around its entire outer perimeter. The flange which is integrally formed on the outside annular extremity of resilient member is secured to components of frame 14. The flange can include mounting holes which allow the bladder to be secured to its frame using screws, pins and/or bolts. The bladder is then placed on the base plate and the support ring is placed over the base plate. Using a securement mechanism such as a screw, bolt, rivet or pin, the components can then be secured relative to the frame 14.

Figure 2A:
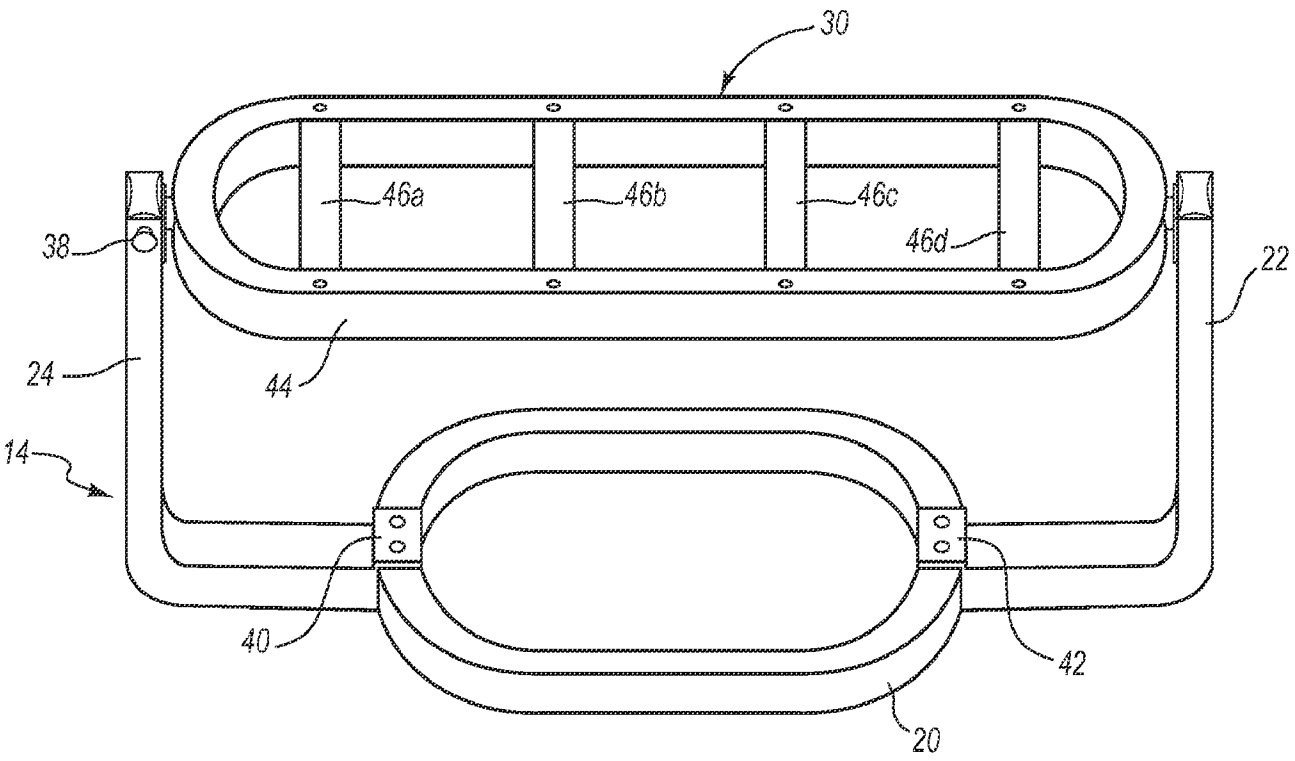
FIG. 2A is a perspective view of a stability cushion exercise machine bench frame according to one aspect of the present invention.

FIG. 2A is a perspective view of a frame 14 of stability cushion exercise machine 10 according to one aspect of the present invention. In the illustrated embodiment, frame 14 includes a base support member 20, first upright support member 22, second upright support member 24 and support frame 30. In the illustrated embodiment, coupling mechanisms 40, 42 and circumferential support member 44 and cross support members 46*a-b* are depicted. Base support member 20 is secured to first upright support member 22 and second upright support member 24 utilizing coupling mechanisms 40 and 42. In the illustrated embodiment, first upright support member 22 and second upright support member 24 have an angled configuration such that a portion of each of members 22 and 24 are positioned on the support surface. The upright support members 22 and 24 can extend at least six inches, or at least one foot so as to support the cushion at a desired height above the ground.

In the illustrated embodiment, support frame 30 includes circumferential support member 44 and cross support members 46*a-d*. Circumferential support member 44 is configured to provide support to the outer perimeter of a cushion positioned thereon. Cross support members 46*a-d* provide additional strength and support to circumferential support member 44. Additionally, cross support members 46*a-d* provides additional support to a cushion attached to support frame 30.

In the illustrated embodiment, rotation pin 38 is depicted. Rotation pin is provided in connection with a pivot mechanism. A user can retract rotation pin to allow the pivot mechanism to be utilized to rotate support frame 30. In this manner, the underside of support frame can be rotated exposing the underside of support frame. This can be useful. For example, a first cushion can be provided on one side of support frame 30 and a second cushion having different parameters from the first cushion can be utilized from the user if different desired cushioning properties are desired.

Figure 2B:
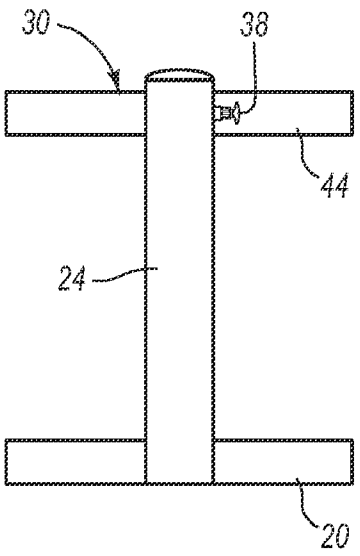
FIG. 2B is a perspective end view of a stability cushion exercise bench according to one aspect of the present invention.

FIG. 2B is a perspective end view of a stability cushion exercise bench according to one aspect of the present invention. In the illustrated embodiment, the juxtaposition of upright support member 24 relative to support frame 30 and base support member 20. Additionally, rotation pin 38 is depicted.

As will be appreciated by those skilled in the art, frame 14 is provided for exemplary purposes and shall not be considered to be limited to the type and configuration of frames than can be provided. A variety of types and configurations of support frames can be utilized without departing from the scope and spirit of the present invention.

Figure 3A:
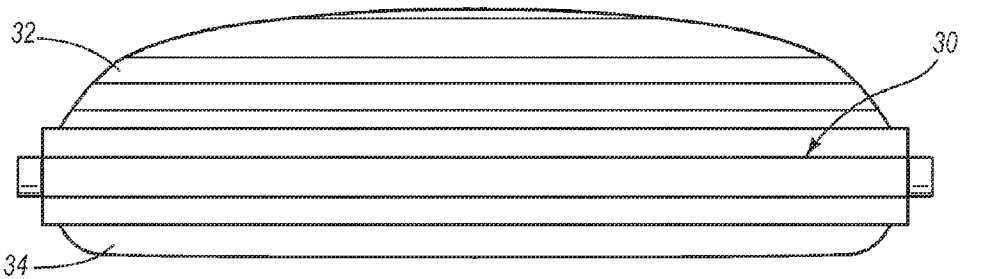
FIGS. 3A, 3B and 3C illustrate a two-sided support cushion according to one aspect of the present invention.
Figure 3B:
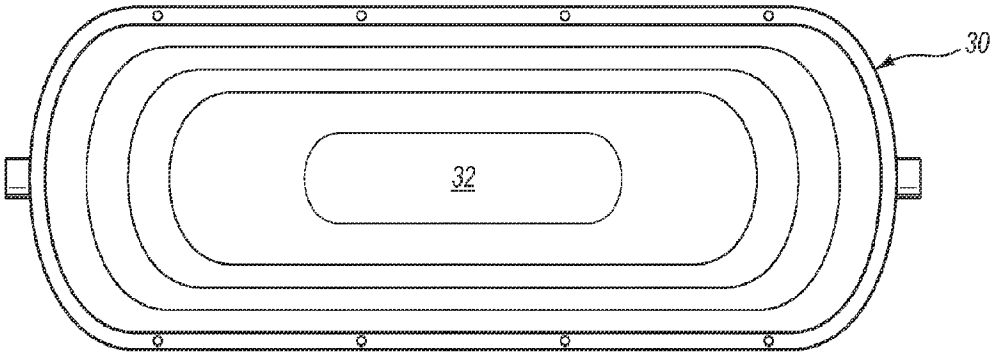
Figure 3C:
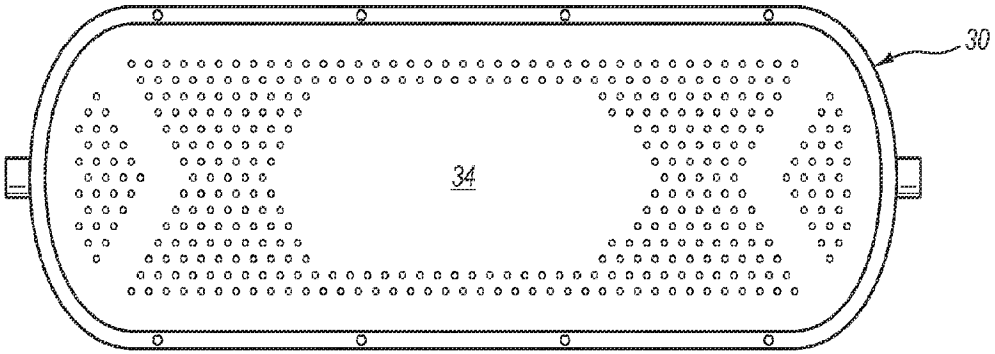

FIGS. 3A, 3B and 3C illustrate a two-sided support cushion according to one aspect of the present invention. In the illustrated embodiment, instability cushion 32 is positioned on an upper facing surface and is secured to support frame 30. In the illustrated embodiment, instability cushion 32 comprises a somewhat arcuate or rounded upper contact surface which is elongate or non-spherical in configuration.

Cushion 32 has a first axis and a second axis wherein the dimensions of the first axis are different from the dimensions of the second axis and wherein the differences between the dimensions of the first axis and the second axis provide differing levels of instability of the cushion 32 in the direction of the first axis and the second axis to provide an improved support surface on which to exercise. In this manner, cushion 32 provides a plurality of shapes that are more conducive to an exercise machine than a swiss ball-type or spherical apparatus. Other shapes can also be provided such as squares, ovals, triangles or other suitable variations of resilient cushion members. By integrating an instability cushion with traditional weight bench designs, allow exercises which are more conducive to exercises known to users.

Cushion 32 has a non-spherical configuration. The non-spherical configuration of cushion component 32 provides a support surface for one or more portions of a user's body when the user is exercising in connection with the exercise machine wherein the non-spherical cushion component provides a greater contact surface than a spherical contact surface having the same radius.

In the illustrated embodiment a secondary cushion 34 is depicted. Secondary cushion 34 has a lower elevation than cushion component 32. Secondary cushion 34 may have different properties from cushion component 32. For example, cushion component 32 may have little or no instability allowing a user to perform exercises on a more stable surface when desired by rotating support frame 30 such that cushion component 34 is positioned in an upward facing direction while cushion component 32 is positioned so as to be out of use.

In the illustrated embodiment, cushion component 34 has a different texture than the annular raised rings which are depicted as being included on instability cushion 32.

As will be appreciated by those skilled in the art, a variety of shapes and configurations of cushions can be provided without departing from the scope and spirit of the present invention. For example, cushions having differing thickness, durometer, resiliency, inflation and material properties can be provided. For example, one cushion may be an air cushion, while the other cushion may be a foam cushion.

Figure 4A:
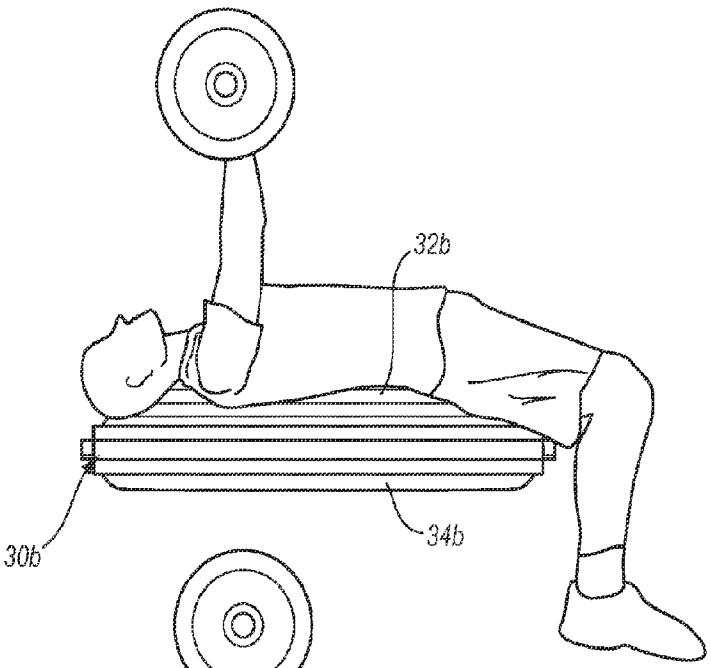
FIGS. 4A and 4B illustrate a user utilizing support cushions having different dimensions according to one aspect of the present invention.
Figure 4B:
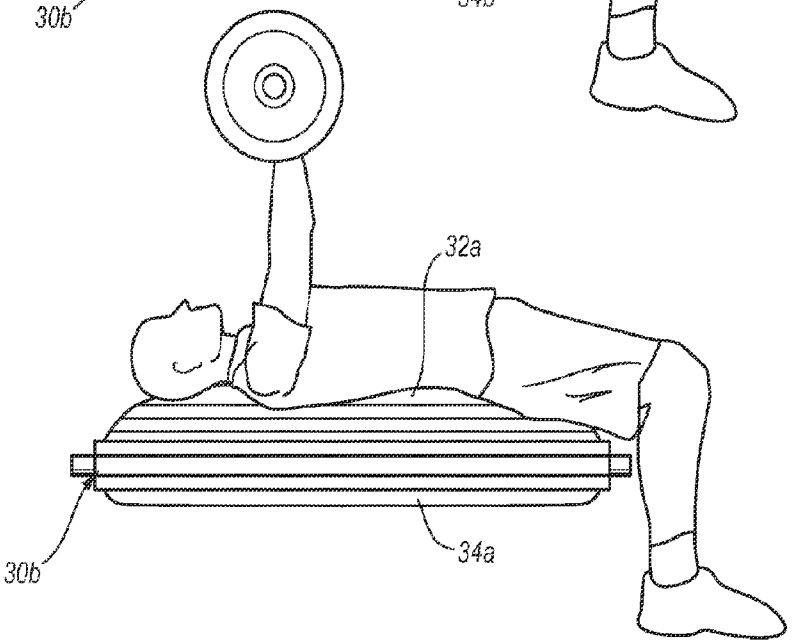

FIGS. 4A and 4B illustrate a user utilizing support cushions having different dimensions according to one aspect of the present invention. For example, 4A depicts a stability cushion exercise machine having a instability cushion 32*b* having a shorter length causing the user's head and buttocks to require greater support and requiring the user to engage desired core muscles. 4B shows an instability cushion 32*a* having a somewhat longer length. As can be appreciated by those skilled in the art, the selected length of the instability cushion provided can vary the exercise experience. For example, cushion 32*a* provides greater support to the user's head and buttocks and a different exercise experience.

Figure 5B:
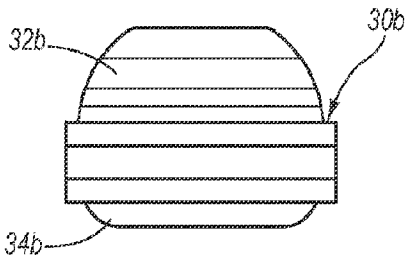
FIGS. 5A and 5B illustrate a cushion having a flat exercise surface according to one aspect of the present invention.
Figure 5A:
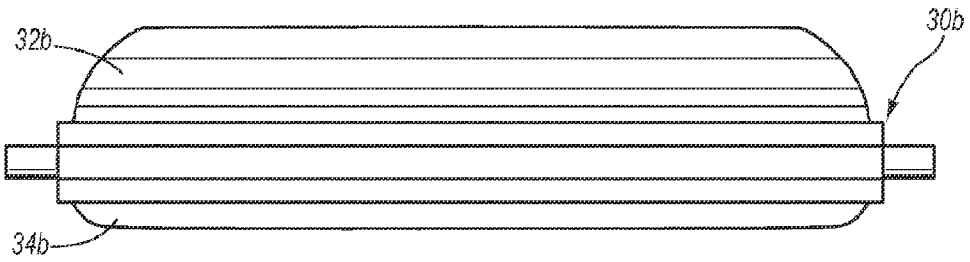

FIGS. 5A and 5B illustrate a cushion 32*a* having a flat contact surface according to one aspect of the present invention. The cushion has a generally smooth arcuate configuration on the sides. The upper contact surface having a flat configuration allows the cushion to provide a degree of instability, but improved comfort and support for certain exercises. In this manner, improved contact is provided while also allowing the resilient nature of the cushion to provided desired flexibility.

Figure 6B:
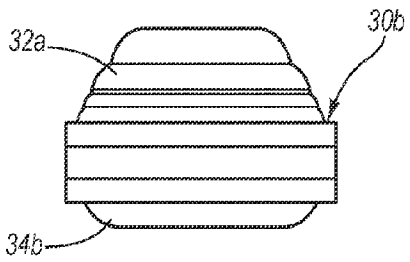
FIGS. 6A and 6B illustrate a cushion having a flat exercise surface and tiered or layered configuration according to one aspect of the present invention.
Figure 6A:
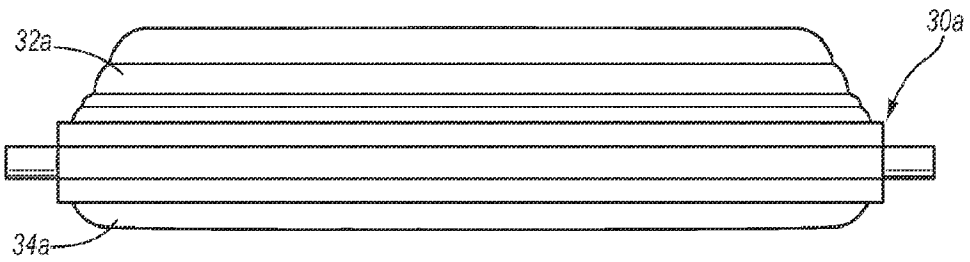

FIGS. 6A and 6B illustrate a cushion having a flat exercise surface and tiered or layered configuration according to one aspect of the present invention. Providing a flat surface with a tiered configuration can provide differing material properties relative to a flat surface. As will be understood by those skilled in the art, varying properties and configurations of resilient bladders and air filled cushions can be selected to vary the benefits of the air cushion without departing from the scope and spirit of the present invention.

Figure 7B:
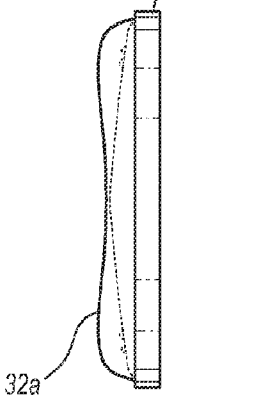
FIGS. 7A and 7B illustrate a cushion having a support surface having a convex configuration according to one aspect of the present invention.
Figure 7A:
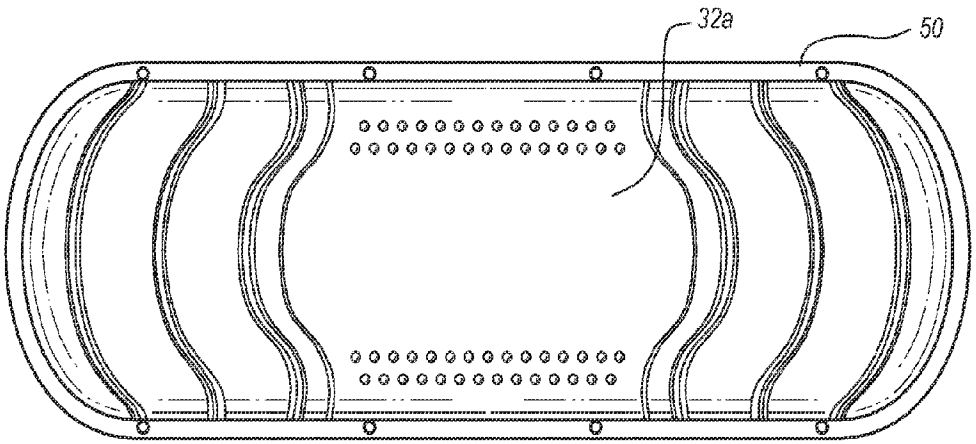

FIGS. 7A and 7B illustrate a 32*a* cushion having a support surface 50 with a convex configuration according to one aspect of the present invention. The convex configuration provides a desired ability to remain positioned on the stability portion of the cushion. In the illustrated embodiment, support surface 50 provides an ergonomic design configured to support a user's body while also allowing for the inflatable nature of cushion 32*a* to provide a desired level of cushion and instability.

Figure 8B:
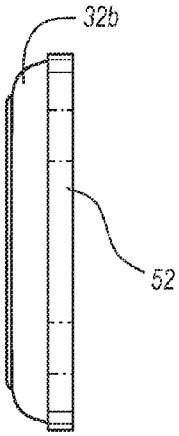
FIGS. 8A and 8B illustrate a cushion having a support surface having a flat configuration according to one aspect of the present invention.
Figure 8A:
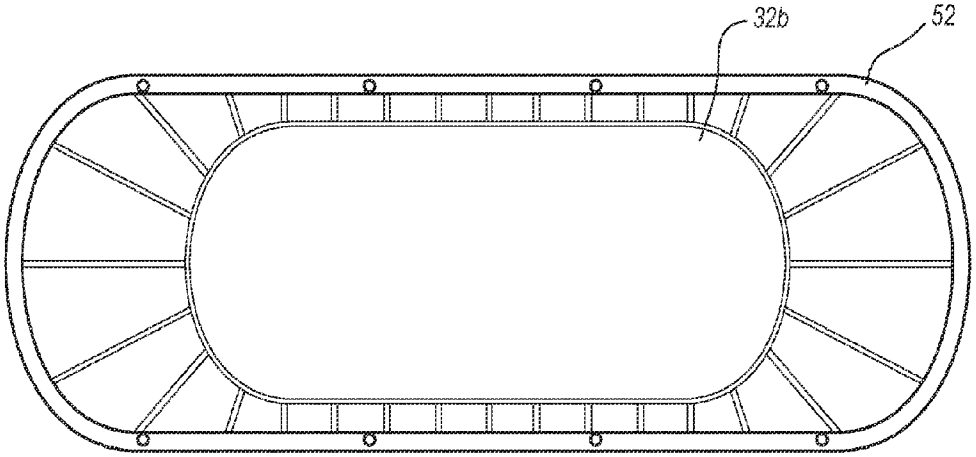

FIGS. 8A and 8B illustrate a 32*b* cushion having a support surface 52 with an essentially flattened upper contact surface according to one aspect of the present invention. In the illustrated embodiment, support surface 52 provides desired user contact but also continues to provide lateral instability which may be different in nature from cushion 32*a* depicted in FIGS. 7A and 7B.

Figure 9B:
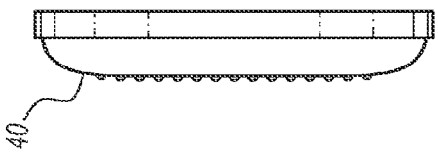
FIGS. 9A and 9B illustrate a cushion having a slightly convex textured upper surface according to one aspect of the present invention.
Figure 9A:
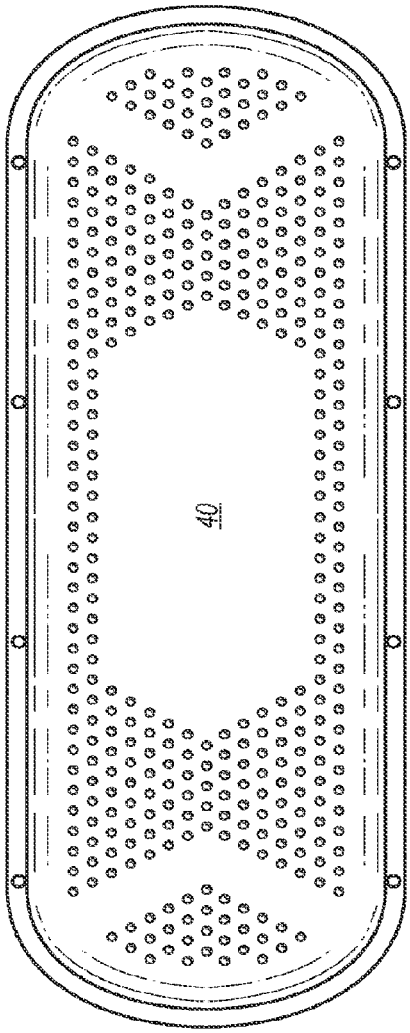

FIGS. 9A and 9B illustrate a cushion 40 with a slightly convex textured upper surface according to one aspect of the present invention. The textured surface provides improved gripping which can be desired for certain types of exercise.

Figure 10B:
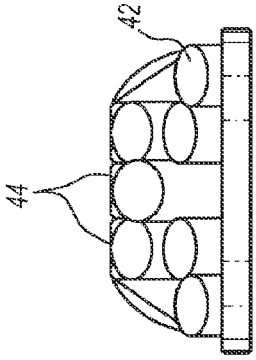
FIGS. 10A and 10B illustrate a cushion having a plurality of columns for providing a desired degree of flexibility while also providing a desired shape of the cushion according to one embodiment of the present invention.
Figure 10A:
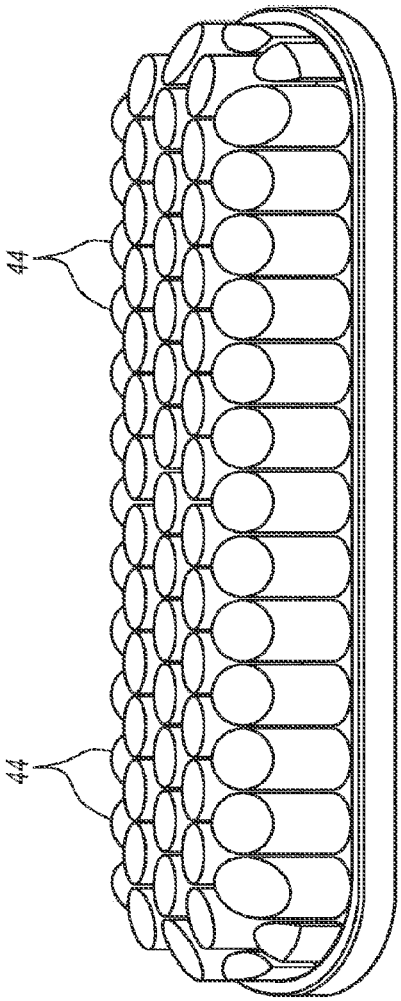
Figure 11C:
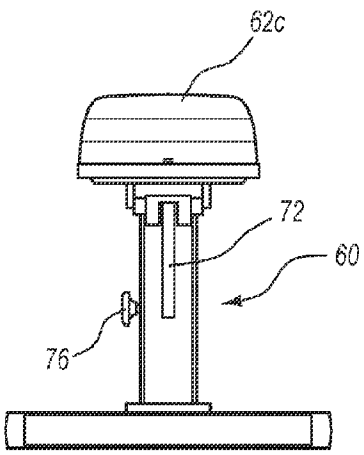
FIG. 11C is an end view of a multi-purpose adjustable exercise bench having an instability cushion according to one embodiment of the present invention.
Figure 11A:
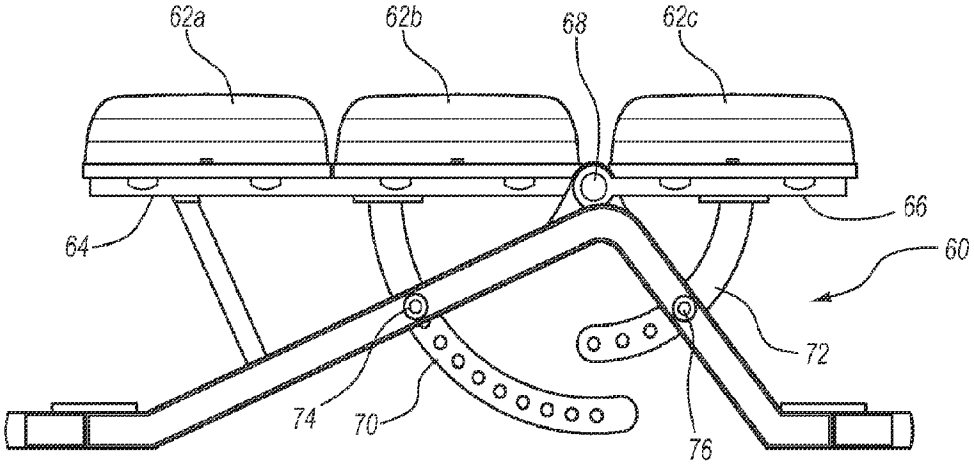
FIG. 11A illustrate a multi-purpose adjustable exercise bench having an instability cushion according to one embodiment of the present invention.
Figure 11B:
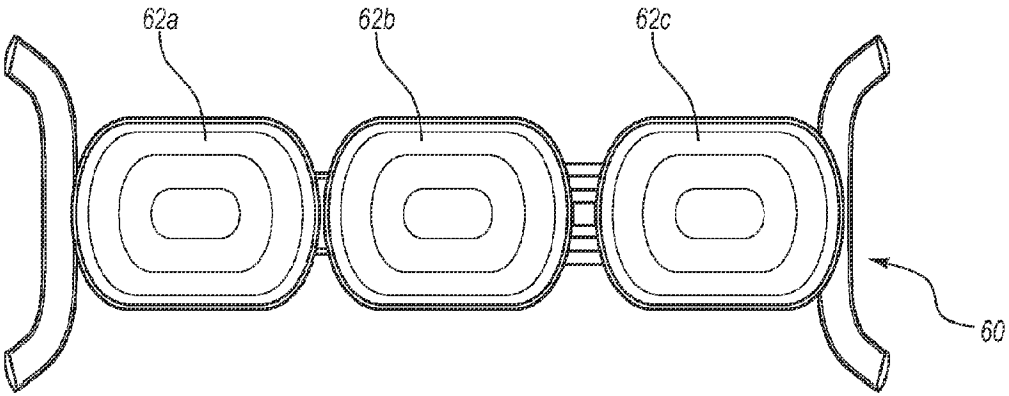
FIG. 11B is a top view of a multi-purpose adjustable exercise bench having an instability cushion according to one embodiment of the present invention.
Figure 12:
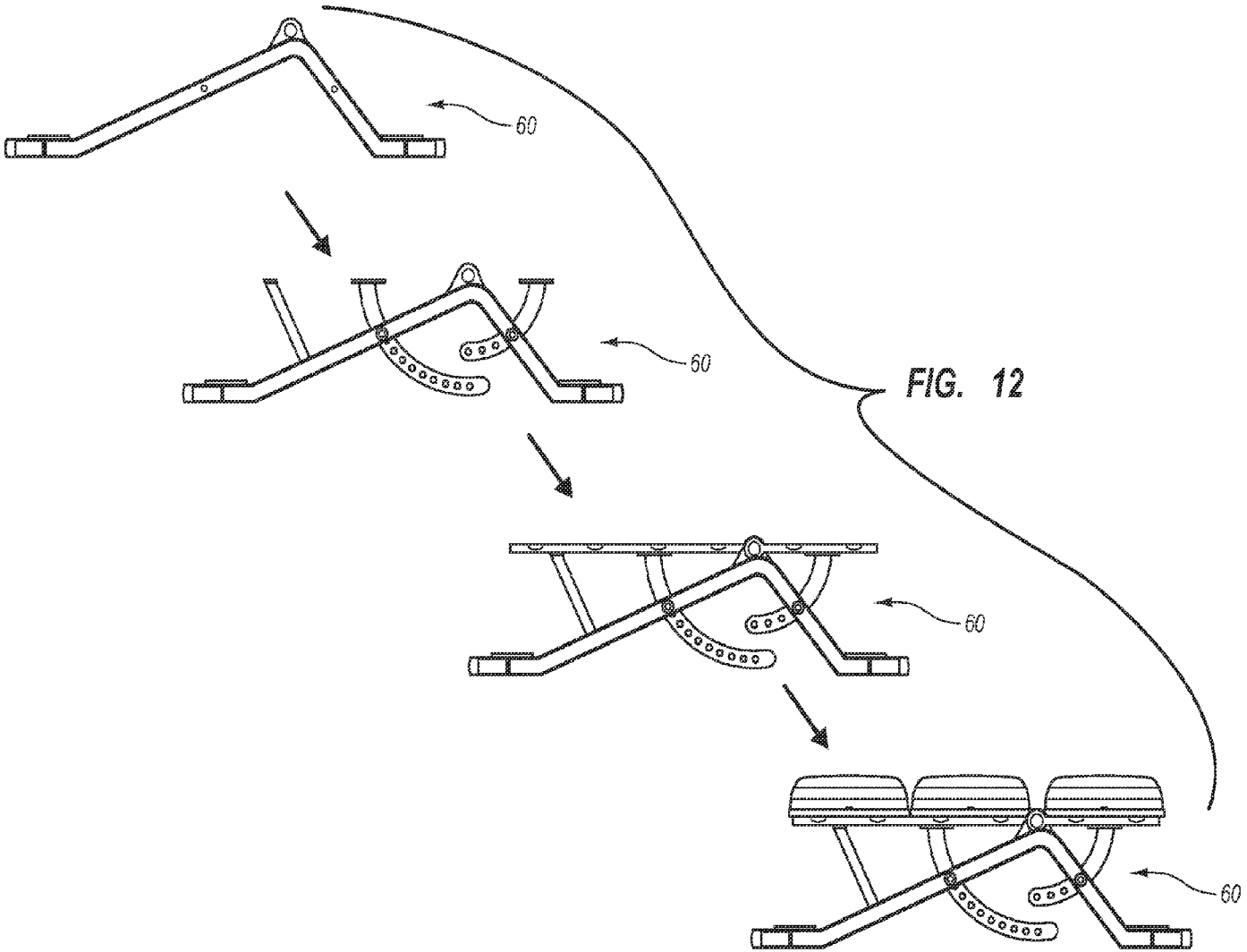
FIG. 12 is a component view of a multi-purpose adjustable exercise bench having an instability cushion according to one embodiment of the present invention.
Figure 13C:
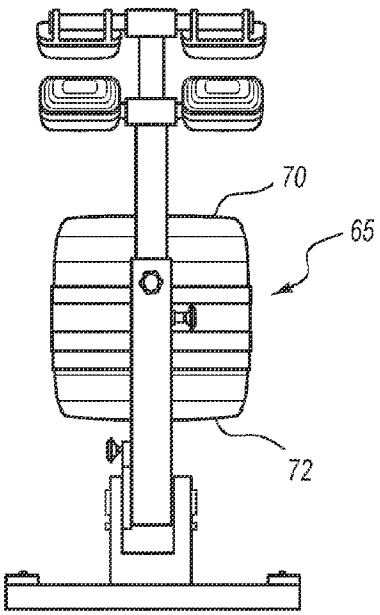
FIG. 13C is an end view of an abdominal exercise bench having an instability cushion according to one embodiment of the present invention.
Figure 13B:
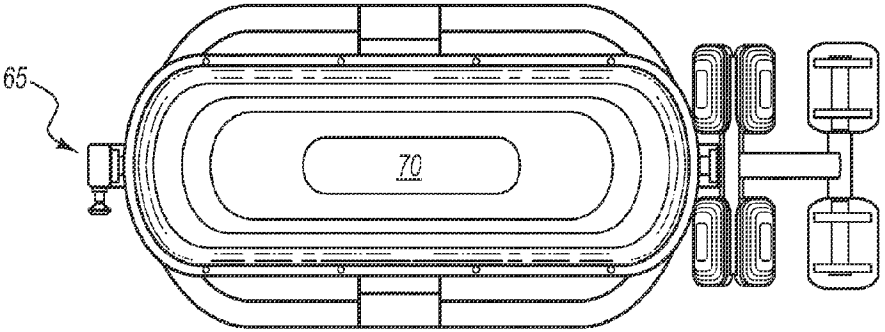
FIG. 13B is a top view of an abdominal exercise bench having an instability cushion according to one embodiment of the present invention.
Figure 13A:
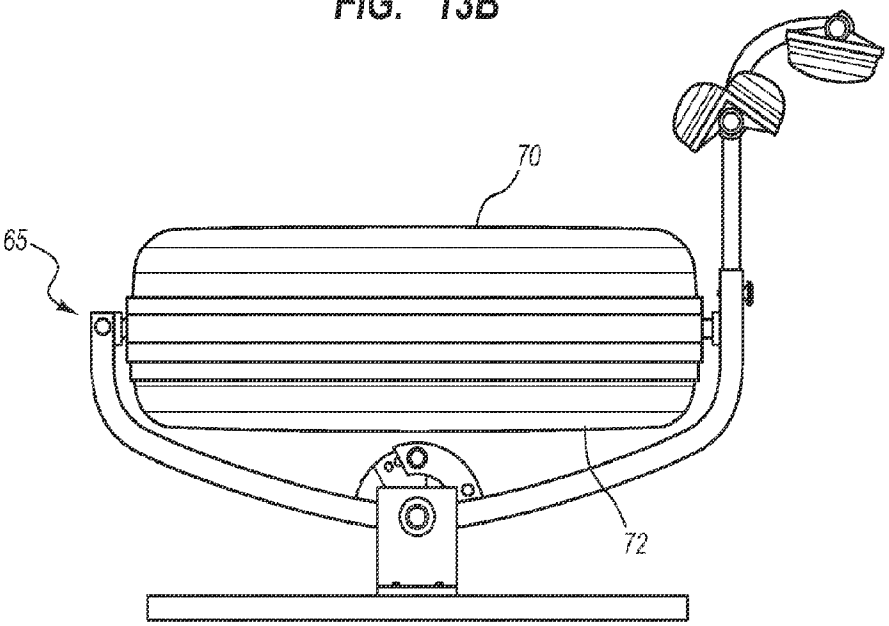
FIG. 13A illustrates an abdominal exercise bench having an instability cushion according to one embodiment of the present invention.
Figure 14:
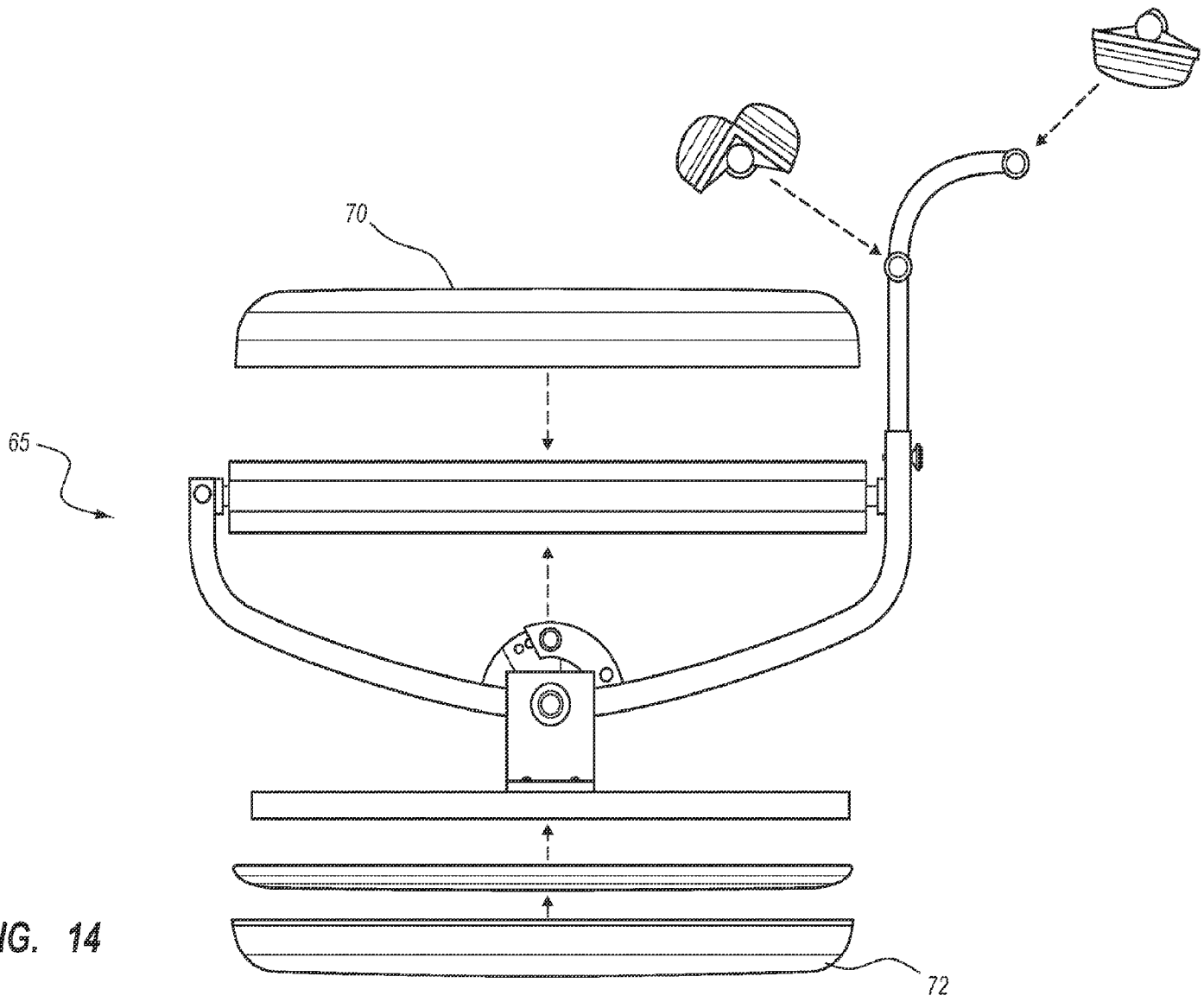
FIG. 14 is a component view of an abdominal exercise bench having an instability cushion according to one embodiment of the present invention.
Figure 15C:
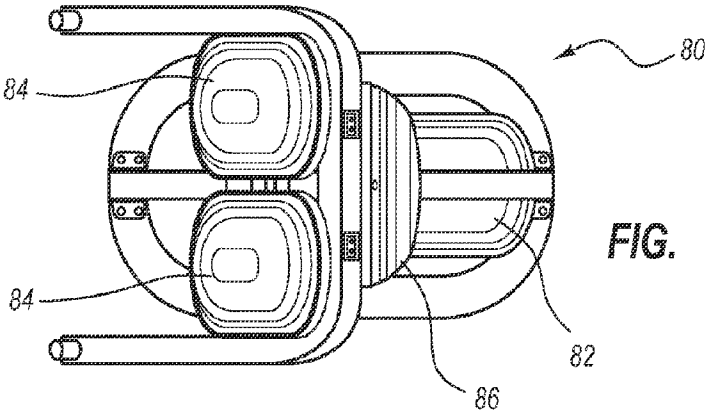
FIGS. 15A, 15B, and 15C, collectively referred to as FIG. 15, illustrate a preacher curl exercise machine having an instability cushion according to one embodiment of the present invention.
Figure 15A:
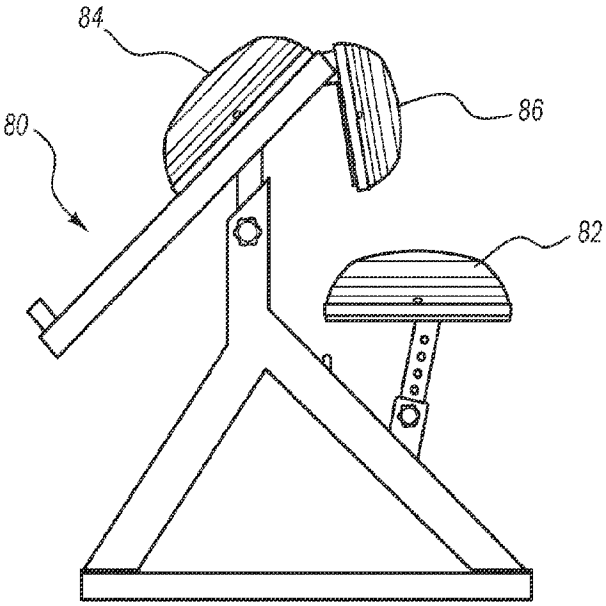
Figure 15B:
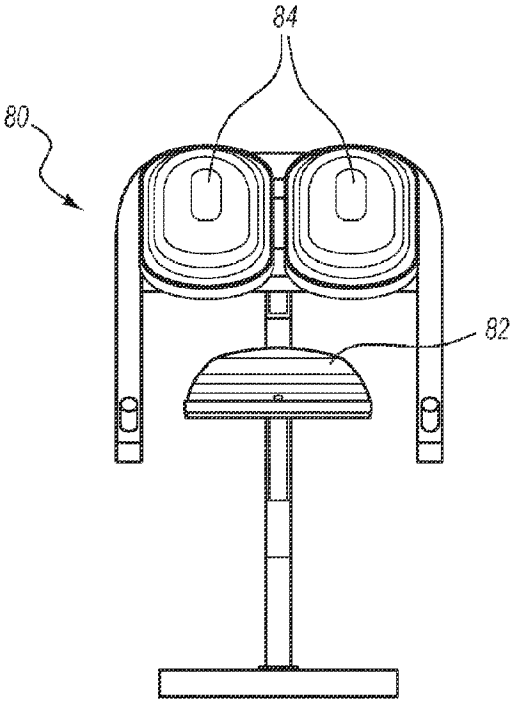
Figure 16:
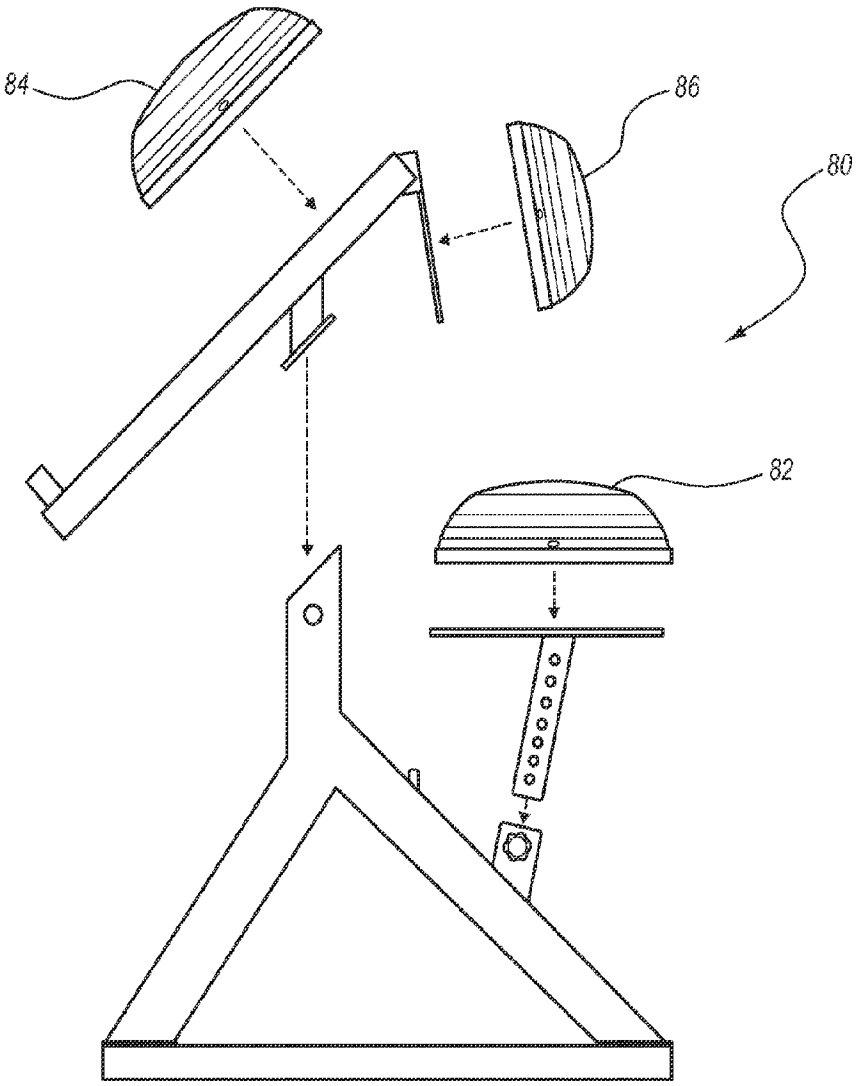
FIG. 16 is a component view of a preacher curl exercise machine having an instability cushion according to one embodiment of the present invention.
Figure 17C:
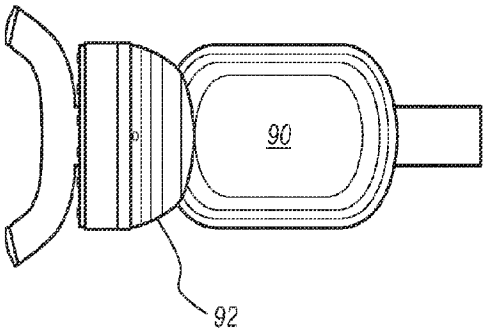
FIGS. 17A, 17B, and 17C, collectively referred to as FIG. 17, illustrate an incline bench exercise machine having an instability cushion according to one embodiment of the present invention. an incline bench exercise machine having an instability cushion according to one embodiment of the present invention.
Figure 17B:
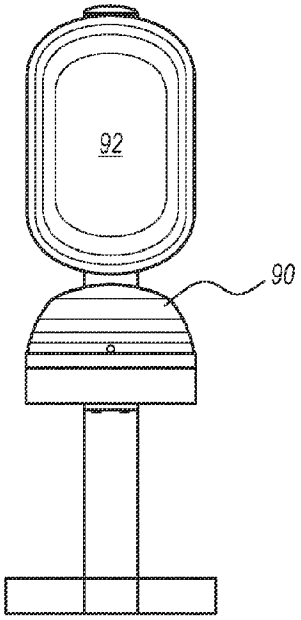
Figure 17A:
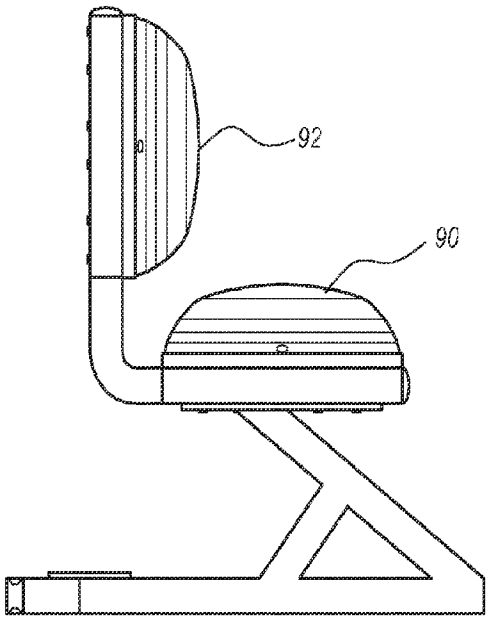
Figure 18:
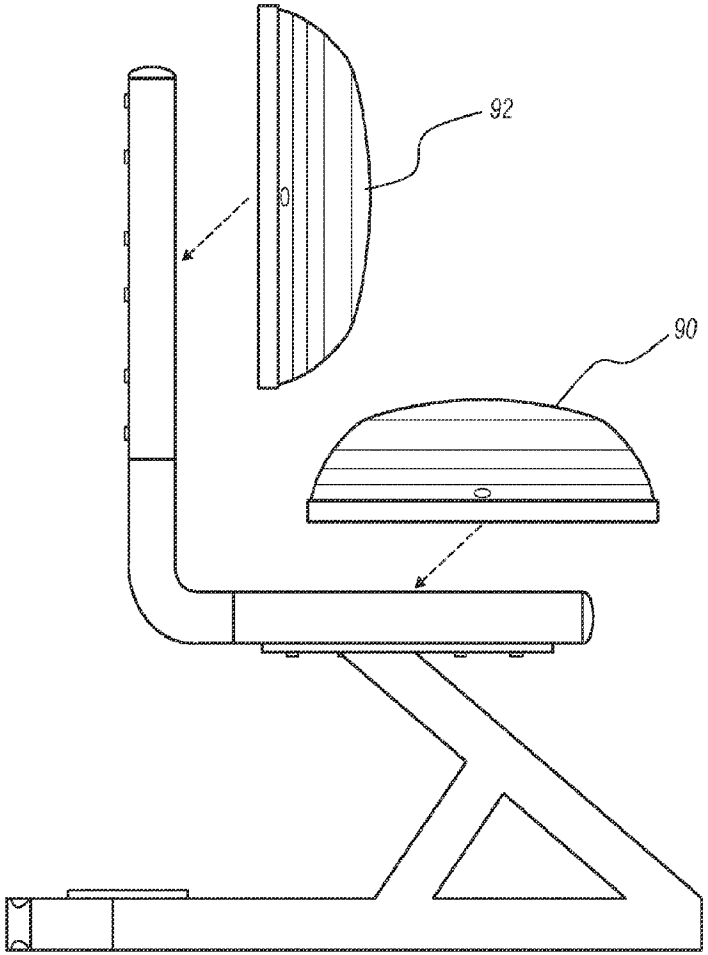
FIG. 18 is a component view of an incline bench exercise machine having an instability cushion according to one embodiment of the present invention.
Figures 19A, 19B, 19C, 19D:
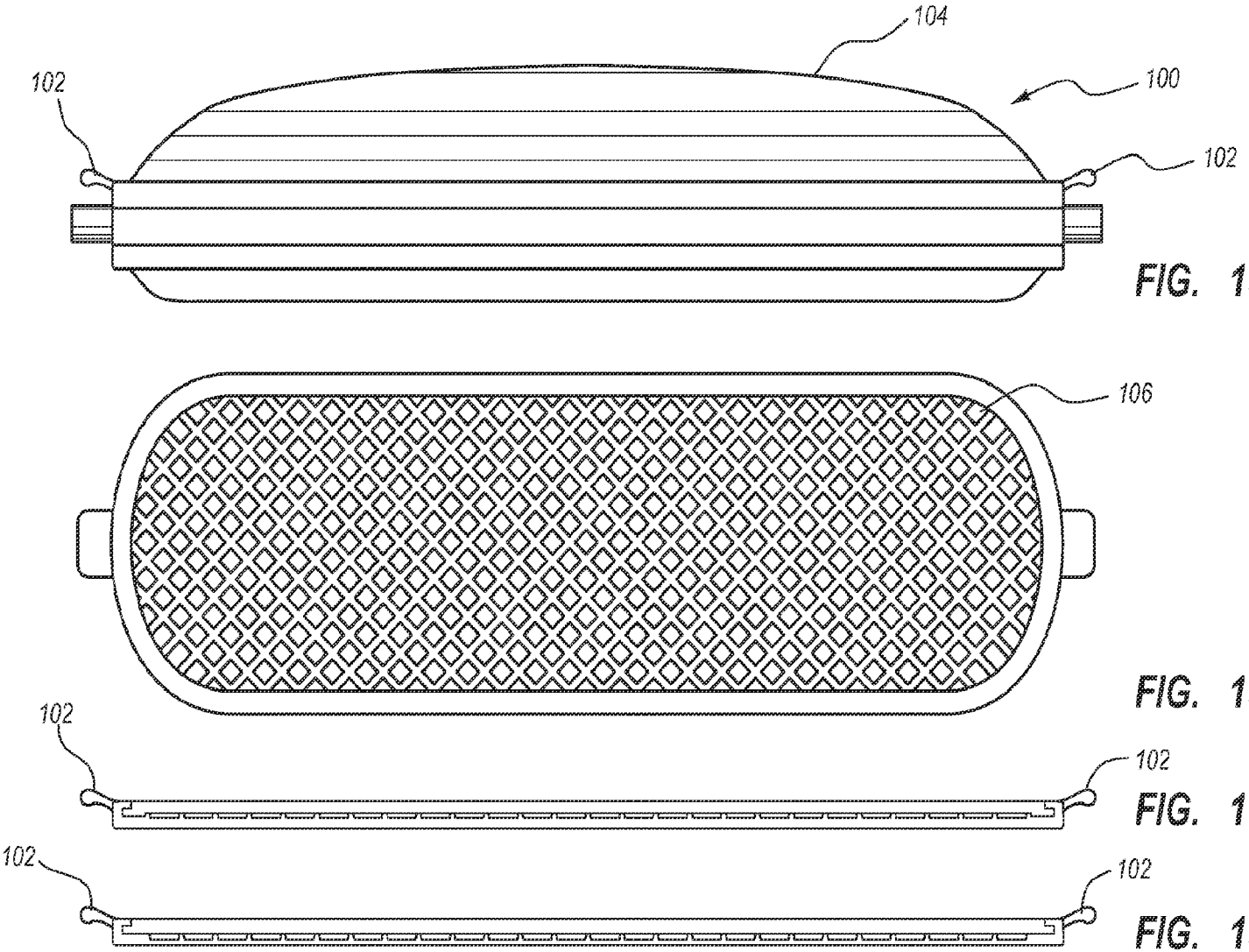
FIGS. 19A, 19B, 19C, and 19D, collectively referred to as FIG. 19, illustrate one embodiment of an instability cushion according to one embodiment of the present invention.

FIGS. 10A and 10B illustrate a cushion 42 having a plurality of columns 44 for providing a desired degree of instability while also providing a desired shape of the cushion according to one embodiment of the present invention. The columns 44 provide a desired level of instability, while also providing a desired degree of uniformity which may not be provided by a cushion comprising an inflated bladder. As with other design features disclosed in the application, the columns 44 are but one design alternative and should not be considered to be limiting in scope.

FIGS. 11A, 11B, 11C, and 12 illustrate a multi-purpose adjustable exercise bench 60 having an instability cushion according to one embodiment of the present invention. In the illustrated embodiment, multi-purpose exercise bench 60 includes a first cushion 62*a*, a second cushion 62*b* and a third cushion 62*c*.

A longer support portion 64 comprises first cushion 62*a* and second cushion 62*b*. The shorter support component 66 includes a single cushion 62*c*. One or both of the longer support component 64 and shorter support component 66 can be adjusted to provide desired configurations for exercise. A support pivot 68 is depicted. Support pivot 68 allows one or both of longer support component 64 and shorter support component 66 to be adjusted to differing angles to accommodate various types of exercise.

For example, the arcuate support members 70 and 72 include selectively removable pin securement members 74 and 76. By removing one or both of pins 74 and 76 and angling one or both of shorter support component 66 and longer support component 64 about support pivot 68, the user can change the configuration of the bench and perform different exercise which may not be available on a simple bench.

The multi-purpose adjustable exercise bench 60 is provided for illustrative purposes to illustrate different functionality of exercises benches that can be provided with instability cushions according to one embodiment of the present invention.

FIGS. 13A, 13B, 13C and 14 illustrates an abdominal exercise bench 65 having an instability cushion 70 according to one embodiment of the present invention. The abdominal exercise apparatus 65 provides apparatus for supporting a user's legs and allowing the user to lie on the instability cushion or alternatively the secondary cushion member 72. Various components of the exercise bench are adjustable to provide varying exercise parameters as desired by the user.

FIGS. 15A, 15B, 15C, and 16 illustrate a preacher curl exercise machine 80 having an instability cushion according to one embodiment of the present invention. In the embodiment, the seat comprises a seat instability cushion 82. Further arm/elbow rests comprise arm instability cushions 84. Various components of the machine 80 are adjustable to provide a desired configuration of the machine 80 and for users of different heights. The preacher curl exercise machine 80 includes the seat instability cushion 82, a chest instability cushion 86 and two elbow instability cushion 84.

FIGS. 17A, 17B, 17C and 18 illustrate a chair bench exercise machine having a back instability cushion 90 for sitting and a back instability cushion 92 for a back rest according to one embodiment of the present invention. Thus, the seat and back rest comprise instability cushions for conducting various exercises.

FIGS. 19A, 19B, 19C, and 19D illustrate one embodiment of an instability cushion 100 according to one embodiment of the present invention. An outer lip runs around the perimeter of the resilient bladder of the upper cushion 104 forming the outside surface of the cushion. The upper cushion 104 provides an instability component. On the underside a grid pattern is provided to form a textured surface which minimizes slipping during exercise.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. An instability exercise machine comprising:

a frame having one or more upright support members;

a back instability cushion comprising an air-filled bladder secured to the frame, the back instability cushion providing a support surface for the back of a user's body when in a lying position when the user is performing an exercise in connection with the instability exercise machine, wherein the back instability cushion is configured to provide a desired degree of instability to encourage use of core muscles and other stabilizing muscles while exercising on the back instability cushion;

at least one leg support providing support for the user's legs when performing the exercises, wherein the at least one leg support includes an air-filled bladder secured to the frame, the at least one leg support providing a support surface against the user's legs when the user is exercising in connection with the instability exercise machine.

2. An instability exercise machine according to claim 1, wherein the at least one leg support includes at least one support for supporting the back of the user's leg when performing the exercises, wherein the at least one leg support includes an air-filled bladder secured to the frame, the at least one calf support providing a support surface against the back of the user's leg when the user is exercising in connection with the instability exercise machine.

3. An instability exercise machine according to claim 1, wherein the at least one leg support includes at least one support for supporting the back of the user's thigh when performing the exercises, wherein the at least one leg support includes an air-filled bladder secured to the frame, the at least one leg support providing a support surface against the back of the user's thigh when the user is exercising in connection with the instability exercise machine.

4. An instability exercise machine according to claim 1, wherein the at least one leg support includes at least one calf support for supporting the user's calf when performing the exercises, wherein the at least one calf support includes an air-filled bladder secured to the frame, the at least one calf support providing a support surface against the user's calf when the user is exercising in connection with the instability exercise machine.

5. An instability exercise machine according to claim 1, wherein the at least one leg support includes at least one support for supporting the front of the user's leg when performing the exercises, wherein the at least one leg support includes an air-filled bladder secured to the frame, the at least one leg support providing a support surface against the front of the user's leg when the user is exercising in connection with the instability exercise machine.

6. An instability exercise machine according to claim 1, wherein the at least one leg support includes at least one support for supporting the front of the user's shin when performing the exercises, wherein the at least one leg support includes an air-filled bladder secured to the frame, the at least one leg support providing a support surface against the front of the user's shin when the user is exercising in connection with the instability exercise machine.

7. An instability exercise machine according to claim 1, wherein the at least one leg support includes at least one support for supporting the top of the user's foot when performing the exercises, wherein the at least one leg support includes an air-filled bladder secured to the frame, the at least one leg support providing a support surface against the user's foot when the user is exercising in connection with the instability exercise machine.

8. An instability exercise machine according to claim 1, wherein an angle or distance of the at least one leg support relative to a base of the frame is adjustable.

9. An instability exercise machine according to claim 1, wherein the pressure of the air within the at least one leg support is adjustable for different comfort levels.

10. A method of manufacturing the instability exercise machine according to claim 1, comprising:

selecting a size, dimension, and material properties of the air-filled bladder of the back instability cushion, and the air-filled bladder of the at least one leg support to provide a desired level of instability; and manufacturing the back instability cushion and the at least one leg support according to the size, dimension, and material properties selected.

11. An instability exercise machine comprising:

a frame having one or more upright support members;

a buttocks instability cushion comprising an air-filled bladder secured to the frame, the buttocks instability cushion providing a support surface for the buttocks of a user's body when in a prone or sitting position when the user is performing an exercise in connection with the instability exercise machine, wherein the buttocks instability cushion is configured to provide a desired degree of instability to encourage use of core muscles and other stabilizing muscles while exercising on the buttocks instability cushion;

at least one leg support providing support for the user's legs when performing the exercises, wherein the at least one leg support includes an air-filled bladder secured to the frame, the at least one leg support providing a support surface against the user's legs when the user is exercising in connection with the instability exercise machine.

12. An instability exercise machine according to claim 11, wherein the at least one leg support includes at least one support for supporting the back of the user's leg when performing the exercises, wherein the at least one leg support includes an air-filled bladder secured to the frame, the at least one calf support providing a support surface against the back of the user's leg when the user is exercising in connection with the instability exercise machine.

13. An instability exercise machine according to claim 11, wherein the at least one leg support includes at least one support for supporting the back of the user's thigh when performing the exercises, wherein the at least one leg support includes an air-filled bladder secured to the frame, the at least one leg support providing a support surface against the back of the user's thigh when the user is exercising in connection with the instability exercise machine.

14. An instability exercise machine according to claim 11, wherein the at least one leg support includes at least one calf support for supporting the user's calf when performing the exercises, wherein the at least one calf support includes an air-filled bladder secured to the frame, the at least one calf support providing a support surface against the user's calf when the user is exercising in connection with the instability exercise machine.

15. An instability exercise machine according to claim 11, wherein the at least one leg support includes at least one support for supporting the front of the user's leg when performing the exercises, wherein the at least one leg support includes an air-filled bladder secured to the frame, the at least one leg support providing a support surface against the front of the user's leg when the user is exercising in connection with the instability exercise machine.

16. An instability exercise machine according to claim 11, wherein the at least one leg support includes at least one support for supporting the front of the user's shin when performing the exercises, wherein the at least one leg support includes an air-filled bladder secured to the frame, the at least one leg support providing a support surface against the front of the user's shin when the user is exercising in connection with the instability exercise machine.

17. An instability exercise machine according to claim 11, wherein the at least one leg support includes at least one support for supporting the top of the user's foot when performing the exercises, wherein the at least one leg support includes an air-filled bladder secured to the frame, the at least one leg support providing a support surface against the user's foot when the user is exercising in connection with the instability exercise machine.

18. An instability exercise machine according to claim 11, wherein an angle or distance of the at least one leg support relative to a base of the frame is adjustable.

19. A method of manufacturing the instability exercise machine according to claim 11, comprising:

selecting a size, dimension, and material properties of the air-filled bladder of the back instability cushion, and the air-filled bladder of the at least one leg support to provide a desired level of instability; and manufacturing the back instability cushion and the at least one leg support according to the size, dimension, and material properties selected.

20. An instability exercise machine comprising:

a frame having one or more upright support members;

a buttocks instability cushion comprising an air-filled bladder secured to the frame, the buttocks instability cushion providing a support surface for the buttocks of a user's body when in a prone or sitting position when the user is performing an exercise in connection with the instability exercise machine, wherein the buttocks instability cushion is configured to provide a desired degree of instability to encourage use of core muscles and other stabilizing muscles while exercising on the buttocks instability cushion;

at least one arm support providing support for the user's arms when performing the exercises, wherein the at least one arm support includes an air-filled bladder secured to the frame, the at least one arm support providing a support surface against the user's arms when the user is exercising in connection with the instability exercise machine.

* * * * *